US005573467A

United States Patent [19]

Chou et al.

[11] Patent Number: 5,573,467

[45] Date of Patent: Nov. 12, 1996

[54] GOLF CLUB AND SET OF GOLF CLUBS

[75] Inventors: Arthur C. P. Chou, Oceanside; Thomas M. Olsavsky, Escondido, both of Calif.

[73] Assignee: Acushnet Company, Fairhaven, Mass.

[21] Appl. No.: 438,421

[22] Filed: May 9, 1995

[51] Int. Cl.[6] ..... A63B 53/02; A63B 53/04; A63B 53/10

[52] U.S. Cl. ..... 473/289; 473/291; 473/305; 473/319; 473/345

[58] Field of Search ..... 273/167 H, 77 R; 473/289, 291, 305, 319, 345

[56] References Cited

U.S. PATENT DOCUMENTS

| | | | |
|---|---|---|---|
| 3,313,541 | 4/1967 | Benkoczy et al. | 273/80 |
| 3,998,458 | 12/1976 | Inoue et al. | 273/80 R |
| 4,023,801 | 5/1977 | VanAuken | 273/80 B |
| 4,097,626 | 6/1978 | Tennent | 273/80 R X |
| 4,132,579 | 1/1979 | VanAuken | 273/80 R X |
| 4,319,750 | 3/1982 | Roy | 273/80 B |
| 4,455,022 | 6/1984 | Wright | 273/77 A |
| 4,555,112 | 11/1985 | Masghati | 273/77 A |
| 4,757,997 | 7/1988 | Roy | 273/80 R |
| 4,836,545 | 6/1989 | Pompa | 273/80 B |
| 4,889,575 | 12/1989 | Roy | 273/80 B X |
| 5,093,162 | 3/1992 | Fenton et al. | 273/77 R X |
| 5,156,396 | 10/1992 | Akatsuka et al. | 273/80 B X |
| 5,346,217 | 9/1994 | Tsuchiya et al. | 273/167 H X |
| 5,362,055 | 11/1994 | Rennie | 273/167 H |

FOREIGN PATENT DOCUMENTS 1261541 12/1968 United Kingdom .

OTHER PUBLICATIONS

Equipment Update, Driving For Show by Nils Nelson.

*Primary Examiner*—George J. Marlo
*Attorney, Agent, or Firm*—Pennie & Edmonds

[57] ABSTRACT

A set of golf clubs including a golf club comprising a head and a shaft, wherein the head has an extension and the shaft is joined to the extension and extends therefrom at a shaft tip, the shaft tip having a diameter of 0.370–0.4 inch and the head is approximately 220 cc or greater.

15 Claims, 2 Drawing Sheets

GOLF CLUB AND SET OF GOLF CLUBS

BACKGROUND OF THE INVENTION

Large head golf clubs have been sold and used for many years and large diameter shafts, i.e., shafts over 0.370 inches have been proposed (U.S. Pat. Nos. 5,093,162 and 4,132,579).

SUMMARY OF THE INVENTION

Broadly, the present invention is a combination of a supersize golf club head having a shaft with a large diameter tip shaft. More particularly, the invention is directed to the combination of wood club head (preferably a metal wood) having a volume greater than 225 c and a shaft attached thereto having a tip diameter greater than 0.370 inches.

The invention is also directed to a club with a head having between 8 and 12 degrees of loft and a volume greater than 225 c and a shaft having a tip diameter greater than 0.370 inches; a club with a head having approximately 14 degrees of loft and a volume of approximately 220 c and a shaft with a tip diameter greater than 0.370 inches; a club with a head having approximately 18 degrees of loft and a volume of approximately 190 c and a shaft having a tip diameter greater than 0.370 inches; a club with a head having approximately 21 degrees of loft and a volume of approximately 160 c and a shaft having a tip diameter greater than 0.370 inches; and the combination thereof.

DESCRIPTION OF THE PREFERRED EMBODIMENT

Figure 1:
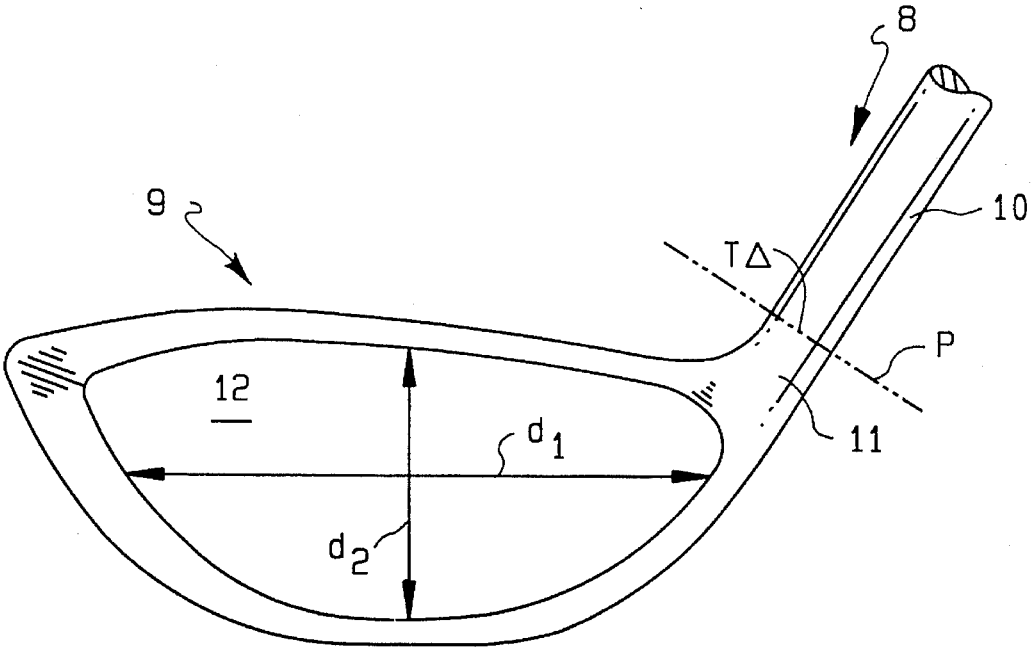
FIG. 1 is a partial front elevational view of the club 35 of the present invention.

Referring to the Figures, club 8 includes head 9 and shaft 10. Head 9 includes head extension 11 with a portion of shaft 10 inserted into extension 11 (which portion is not shown) and the head includes face 12. The attachment of the shaft 10 to the extension 11 forms a plane of joinder P where the shaft emerges from the extension. Shaft 10 has a tip diameter (TD) measured at the plane of joinder P where shaft 10 emerges from extension 11. Head face 12 defines a plane from which the club loft can be defined and includes horizontal dimension $d_1$ and vertical dimension $d_2$. The area of face 11 is computable using these dimensions and other similar dimensions.

Figure 2:
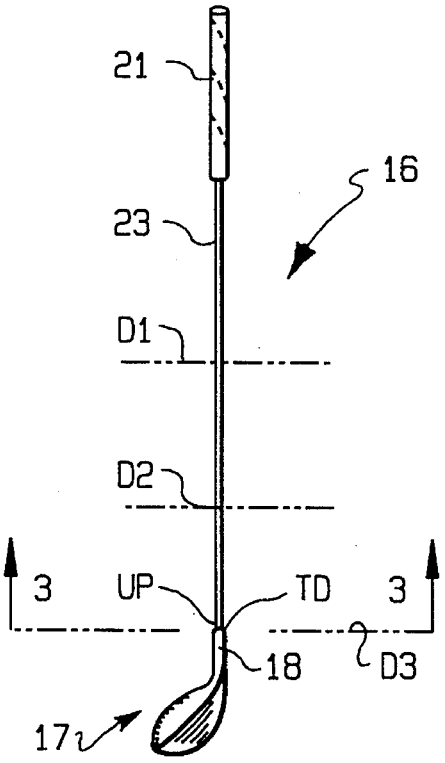
FIG. 2 is an elevational view of an alternative embodiment with a head extension including a hosel extending further above the club head.
Figure 3:
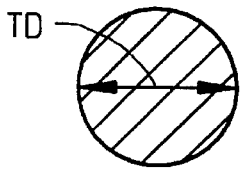
FIG. 3 is a sectional view on line 3—3 of FIG. 2.

Turning to FIGS. 2 and 3, alternative club 16 includes a head 17 and a head extension 18. Also shown are grip 21, shaft 23, shaft diameters D1, D2 and TD. Diameter TD is less than Diameter D2 which is less than diameter D1. The shaft tip diameter (TD) is measured at plane of joinder, i.e., where the shaft 23 emerges from the uppermost point (UP) of extension 18. D2 and D1 are diameters of the shaft and, more particularly, are diameters in the tapered section of the shaft.

The size of wood heads including metal wood heads is measured by the volume such head (including the head extension) displaces when placed in water or other liquid. Heads are classified as standard, midsize, oversize and so forth. The present invention is directed to supersize heads which are heads with volumes of 225 c and greater. Preferably, the club head of the present invention has a volume between 225 c and 275 c and, most preferably, the club head has a volume of approximately 250 c.

Furthermore, the club head is made of a light weight metal and, most preferably, the club head is made from a titanium alloy such as TI64 alloy.

Figure 2A:
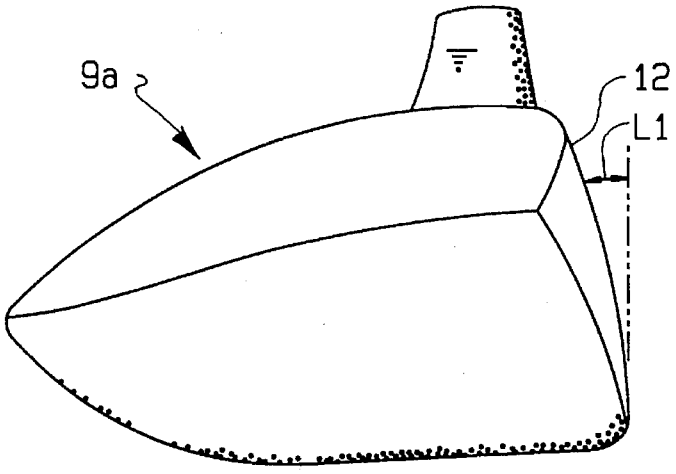
FIG. 2*a* is a side view a first club head.
Figure 2B:
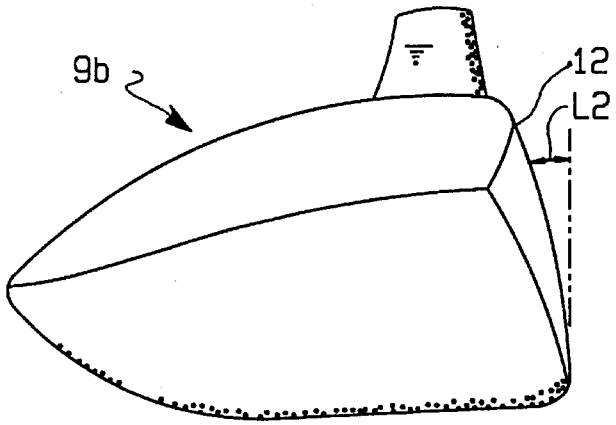
FIG. 2*b* is a side view of a second club head.
Figure 2C:
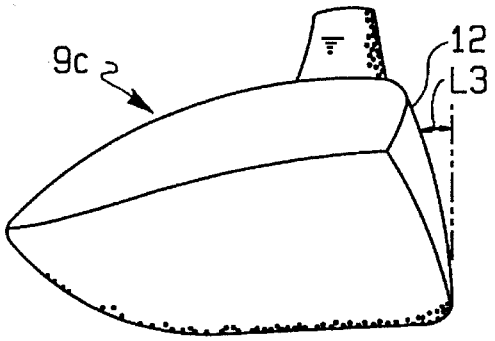
FIG. 2*c* is a side view of a third club head.

The preferred club head has a volume of greater than 225 c and a loft between approximately 8 and 12 degrees. The loft is the angle of the club face plane 12 relative to the vertical plane (not shown). As shown in FIG. 2*a*, another embodiment of the present invention is a club 9*a* with a head having a volume of approximately 220 c, a loft L1 of approximately 14 degrees and shaft tip diameter of approximately 0.390 inches. As shown in FIG. 2*b*, still another embodiment of the present invention is a club 9*b* with a head having a volume of approximately 190 c, a loft L2 of approximately 18 degrees and a shaft tip diameter of approximately 0.390 inches. As shown in FIG. 2*c* yet still another embodiment of the present invention is a club 9*c* with a head having a volume of approximately 160 c, a loft L3 of approximately 21 degrees and a shaft tip diameter of approximately O.390 inches.

Shaft tip diameter (TD) is measured at the plane where the shaft emerges from the head extension. A large shaft tip diameter is a diameter of 0.370 inch or larger. Preferably the shaft tip is in the range of 0.380 to 0.400 inches and, most preferably, the shaft tip is approximately 0.390 inches.

The preferred shaft can be of a tapered tip shaft construction as disclosed in U.S. Pat. No. 4,132,579 or of a constant tip diameter construction as disclosed in U.S. Pat. Nos. 5,093,162 and 4,757,997, which are all disclosed herein by reference. Preferably, the shaft is constructed exclusively of multiple plies that incorporate standard modulus graphite fibers (tensile modulus of approximately 30–38 million psi).

Wherein it is apparent that the invention herein disclosed from the various embodiments will provide many improvements, it will be appreciated that numerous modifications and other embodiments may be made by those of ordinary skill in the art and it is intended that the appended claims cover such modifications and embodiments that fall within the spirit and scope of the present invention.

We claim:

1. A golf club comprising a head and a shaft, wherein the head has an extension and the shaft is joined to the extension and extends therefrom at a shaft tip, the shaft tip having a diameter of 0.370–0.4 inch and the head is approximately 220 cc or greater.

2. The golf club of claim 1 in which the shaft tip diameter is 0.380–0.400 inch.

3. The golf club of claim 1 in which the shaft tip diameter is approximately 0.390 inch.

4. The golf club of claim 1 in which the shaft has a handle and the shaft diameter is greater near the handle than at the shaft tip.

5. The golf club of claim 1 wherein the head has a volume greater than 225 c.

6. The golf club of claim 5 wherein the head has a volume between 225 c and 275 c.

7. The golf club of claim 6 wherein the head has a volume of approximately 250 c.

8. The golf club of claim 7 wherein the head has a loft between approximately 8 and 12 degrees.

9. The golf club of claim 1, wherein the head has a loft of approximately 14 degrees.

10. The golf club of claim 9 in which the shaft tip diameter is 0.380–0.400 inch.

11. The golf club of claim 9 in which the shaft tip diameter is approximately 0.390 inch.

12. A set of golf clubs comprising a first head and a first shaft attached thereto, in which the first head is approximately 220 cc or greater and has a loft between 8 and 12 degrees and has an extension and the first shaft is joined to the extension and extends therefrom at a first shaft tip, and the first shaft tip diameter is 0.370–0.4 inch; and a second head having a second extension and a second shaft attached thereto which extends from the second extension at a second shaft tip, in which the second head has a volume of approximately 220 cc and a loft of approximately 14 degrees and the second shaft tip diameter is 0.370–0.4 inch.

13. The set of golf clubs in claim 12 further comprising a third head and third shaft attached thereto, wherein the third head has a volume of approximately 190 c and a loft of approximately 18 degrees and the third shaft has a tip diameter greater than 0.370 inch.

14. The set of golf clubs in claim 13 further comprising a fourth head and a fourth shaft attached thereto, in which the fourth head has a volume of approximately 160 c and a loft of approximately 21 degrees and the fourth shaft has a tip diameter greater than 0.370 inch.

15. The set of golf clubs in claim 14 wherein the first, second, third and fourth heads have respective extensions and the first, second, third and fourth shafts are joined to the respective extensions forming planes of joinder and the diameter of the first, second, third and fourth shafts at such planes is 0.380–0.400 inch.

* * * * *